United States Patent [19]

Arima et al.

[11] Patent Number: 4,558,643

[45] Date of Patent: Dec. 17, 1985

[54] PROOF-PRINTING MACHINE

[75] Inventors: Makoto Arima, Amagasaki; Takashi Tsumura, Habikino; Akihiko Ueda, Nishinomiya, all of Japan

[73] Assignee: Kurashiki Boseki Kabushiki Kaisha, Okayama, Japan

[21] Appl. No.: 710,307

[22] Filed: Mar. 8, 1985

[30] Foreign Application Priority Data

Mar. 9, 1984 [JP] Japan ..... 59-46066

[51] Int. Cl.[4] ..... B41F 3/28; B41F 3/60

[52] U.S. Cl. ..... 101/158; 101/282

[58] Field of Search ..... 101/158, 161, 169, 250, 101/252, 256, 260, 264, 269, 270, 282, 286, 283–285; 74/27

[56] References Cited

U.S. PATENT DOCUMENTS 3,413,918 12/1968 Gingras ..... 101/158

3,745,838 7/1973 Brems ..... 101/250

*Primary Examiner*—J. Reed Fisher

*Attorney, Agent, or Firm*—Wenderoth, Lind & Ponack

[57] ABSTRACT

There is disclosed a proof-printing machine comprising an elongated table for mounting a printing plate thereon detachably which is supported by a base frame, a carriage means being movable along the table in the longitudinal direction hereof, a head means being mounted on the carriage means, a doctor blade means for applying ink onto the printing plate so supported by the head means as to be adjustable of its angle and contact pressure against the printing plate, a cylindrical press drum being supported by the head means so as to be rotatable about the axis thereof and adjustable of its contact pressure against the printing plate onto the peripheral surface of which a blank material to be printed is fixed, a pair of timing belt means for transferring the carriage each of which is spanned between a pair of pulleys provided at each end portion of the side wall of the table respectively, a pulse motor for driving said timing belt means, and control means for driving the pulse motor according to a predetermined optimum driving pattern.

4 Claims, 9 Drawing Figures

PROOF-PRINTING MACHINE

FIELD OF THE INVENTION

The present invention relates to a proofing machine for printing, such as a gravure printing.

BACKGROUND OF THE INVENTION

The gravure printing is one kind of the intaglio printing and is characterized in that print having a fine gradation can be obtained in multi-color or mono-color printing, as is well known to those skilled in the art.

Prior to actual printing with use of the gravure printing machine, color matching of ink is done usually. Color matching includes a proofing process with use of spatula application.

This proofing process is done conventionally in such a manner as follows; first a skilled person determines compound of the target color according to his sense referring a proof print of primary color ink, compounds ink actually, then applies said ink on a printing plate with a spatula and makes a proof print and, finally, decides pass or fail by observing the proof print. If failed, the ink is recompounded by adding primary color ink and is decided pass or fail by observing the proof print with use of the ink recompounded. Such compounding is repeated until pass-decision is obtained.

Such manual color matching as mentioned above has disadvantages as follows;

(a) Since color difference between the color of the proof print and the target color is decided only by observation, different decisions may be obtained according to the senses of the skilled persons in charge and, accordingly, there caused such troubles that printed products are refused to accept by the person who ordered printing thereof.

(b) Since the ink is applied on the printing plate manually with use of the spatula on proof printing, proofing conditions such as applying speed and pressure are varied slightly at every proof printing. Namely, reproductive stability thereby is inferior.

Contrary to the above, color matching method with use of computer has been proposed into which recent developments in the field of the chromatology are introduced.

In this method, tristimulus values X, Y, Z of the target color are obtained by measuring spectroscopic reflection factors of the target color in the visible light zone and the luminosity index L and chromaticness indexes a, b in the Lab space are calculated based upon the tristimulus values X, Y, Z. Those indexes about the target color are stored into the memory of the computer. Also, the luminosity index L' and chromaticness indexes a', b' about the color obtained by proof-printing with use of the ink having been compounded are calculated. The color difference is calculated by comparing these indexes L' a', b' about the color of the proof print with those L, a, b about the target color and the ink is recompounded based upon the color difference obtained. According to the method, the problem (a) above mentioned is dissolved.

Moreover, there has been known an automatic proof printing machine being capable of printing under constant printing conditions.

This machine has a cylindrical press drum on the peripheral surface of which a material to be printed thereon is fixed. On proof printing, the press drum is moved in contact with the printing plate by a reversible electric motor.

However, the conventional proof-printing machine of this type has disadvantages in that it is impossible to obtain high acceleration and/or deceleration on driving the press drum, that it is impossible to obtain high velocity within a short distance, that it is difficult to obtain an objective velocity exactly and that only an inferior reproductive stability can be obtained.

SUMMARY OF THE INVENTION

An object of the present invention is to provide a proof-printing machine having a high reproductive stability.

Another object of the present invention is to provide a proof-printing machine in which a press drum is controlled under a predetermined optimum driving pattern.

A further object of the present invention is to provide a proof-printing machine in which a press drum can be driven with high acceleration and/or deceleration and, therefore, a high velocity can be realized within a short distance.

According to the present invention, there is provided a proof-printing machine comprising an elongated table for mounting a printing plate thereon detachably which is supported by a base frame, a carriage means being movable along the table in the longitudinal direction hereof, a head means being mounted on the carriage means, a doctor blade means for applying ink onto the printing plate so supported by the head means as to be adjustable of its angle and contact pressure against the printing plate, a cylindrical press drum being supported by the head means so as to be rotatable about the axis thereof and adjustable of its contact pressure against the printing plate onto the peripheral surface of which a blank material to be printed is fixed, a pair of timing belt means for transferring the carriage each of which is spanned between a pair of pulleys provided at each end portion of the side wall of the table respectively, a pulse motor for driving said timing belt means, and control means for driving the pulse motor according to a predetermined optimum driving pattern, said control means having memory means memorizing at least one acceleration pattern for accelerating the carriage up to a predetermined objective velocity within a distance defined between start position and first position being set just before the beginning end of the printing area of the printing plate and at least one deceleration pattern for decelerating the carriage from the objective velocity to zero within a distance defined between second position and stop position, said second position being defined as a position where the press drum has been passed the printing area completely and said optimum driving pattern being determined based upon said acceleration and deceleration patterns according to the objective velocity being selectively designated.

According to the present invention, it becomes possible to obtain stable proofing conditions, since the press drum is driven according to the same optimum driving pattern as far as the same objective velocity is designated. Accordingly, reproductive stability in proof printing is highly improved. This enables accurated color matching with use of the computer.

Further, according to the proof-printing machine of the present invention, such a high objective printing velocity as of 100 m/min. can be obtained within a relatively short distance, for instance as of about 350 mm.

The proof-printing machine according to the present invention can be used as a testing machine for quality control of ink or printing materials such as papers and/or as a testing machine for testing physical qualities such as durability of ink or printing materials or printing suitability between ink and printing materials.

BRIEF DESCRIPTION OF THE DRAWINGS

The present invention will be more fully understood and further advantages will become apparent when reference is made to the following detailed description of the accompanying drawings, in which;

FIG. 3(*b*) is a cross sectional view along the line II—II of the FIG. 3(*a*);

DESCRIPTION OF THE PREFERRED EMBODIMENT

Figure 1:
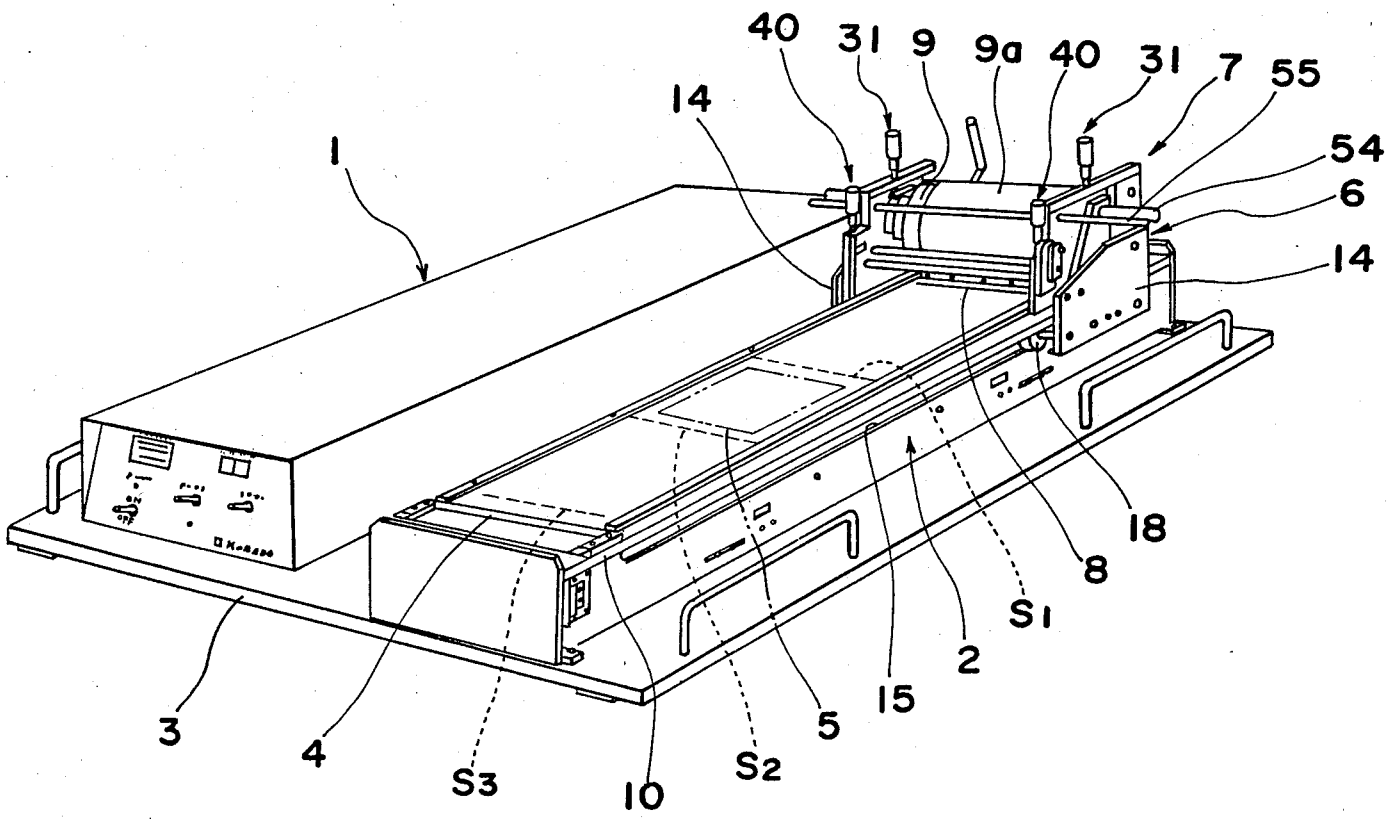
FIG. 1 is a perspective view of the proof-printing machine according to the present invention.

FIG. 1 shows a proof-printing machine according to the present invention.

Referring to FIG. 1, a control unit 1 and an elongated mounting table 2 are fixed parallel to each other on a base frame 3. A printing plate 4 is mounted on the mounting table 2 fixedly. The printing plate 4 has a printing area 5 at the central portion thereof in which gravure ink cells are formed. A carriage 6 is provided movably along said mounting table 2. A head 7 being carried by the carriage 6 supports a doctor blade 8 for applying ink to the printing area 5 of the printing plate 4.

This doctor blade 8 is moved together with the head 7 contacting onto the surface of the printing plate 4 and applies ink having been supplied before the printing area 5 into ink cells thereof. The head 7 supports a cylindrical press drum 9 rotatably about the axis thereof at the rear side of the doctor blade 8. On the peripheral surface of the head 7, a material 9*a* to be printed for proof print is mounted and the ink applied into the printing area 5 is transferred onto said material 9*a* as it rotates contacting onto the printing area 5.

Figure 2:
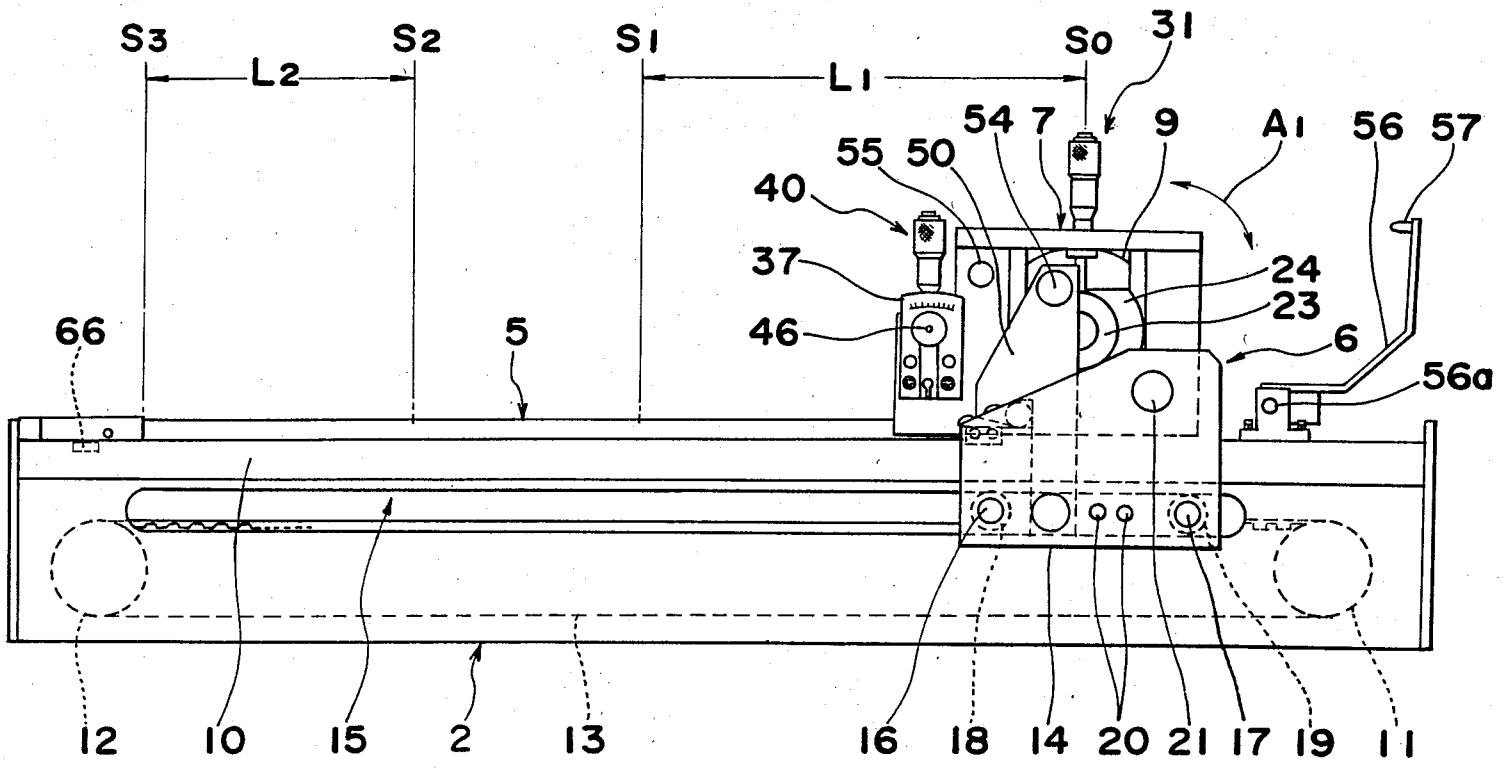
FIG. 2 is a side view of the proof-printing machine shown in FIG. 1.

As shown by dotted line in FIG. 2, a pair of pulleys 11 and 12 are arranged inside of the mounting table 2 and each end portion thereof. Between these two pulleys 11 and 12, an endless timing belt 13 is spanned. The carriage 6 is connected to the upper run of the timing belt 13 so as to move together with the latter.

The carriage 6 has a pair of side plates 14 and 14 being positioned at both sides of the mounting table 2 respectively. The side plates 14, 14 are fixed to each other by two shafts 16 and 17 passing through an elongated aperture 15 provided on the side wall of the mounting table 2.

Two rollers 18, 18 are mounted rotatably about the shaft 16 at both end portion thereof and, similarly, two rollers 19, 19 are mounted about the shaft 17. These rollers are guided by guide means provided along said elongated aperture 15 so as to guide the carriage 6 smoothly. The carriage 6 is connected to the timing belt 13 by two connecting rods 20 fixed between the pair of side plates 14 and 14.

The head 7 is hingedly coupled to the carriage 6 by a connecting shaft 21 being fixed between the upper portions of the side plates 14, 14. Therefore, the head 7 is pivotable about the connecting shaft 21 as indicated by an arrow $A_1$ in FIG. 2.

Figure 3:
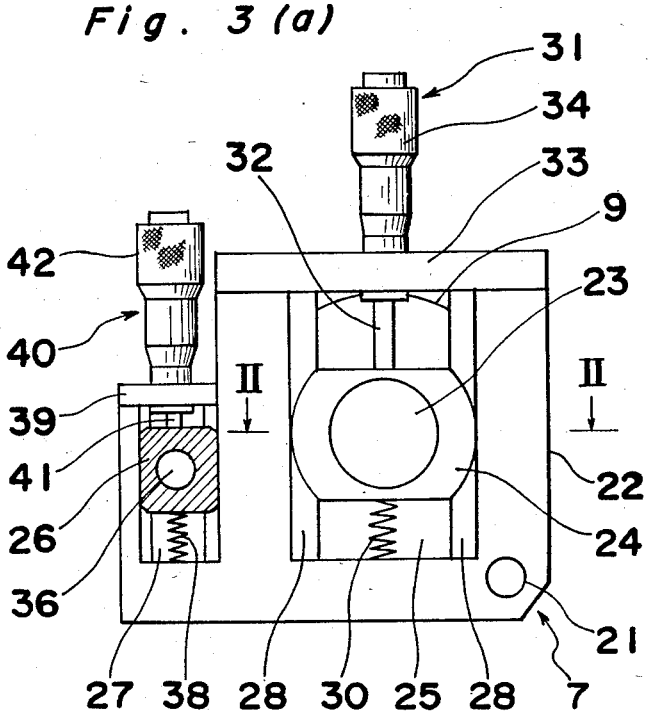
FIG. 3(*a*) is a side view of the head of the proof-printing machine.
Figure 3B:
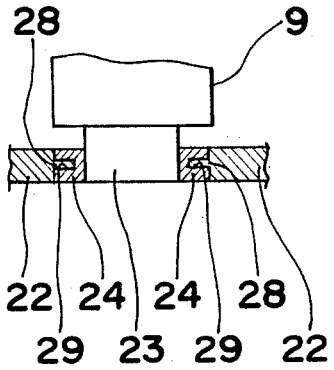

The head 7 has a pair of support plates 22, 22 for supporting the doctor blade 8 and the press drum 9 as shown in FIG. 3(*a*). The support plate 22 has a window 25 for accepting a bearing means 24 supporting the shaft 23 of the press drum 9 rotatably and one more window 27 for accepting a bearing means 26 supporting the doctor blade 8.

Along each of side edges defining the window 25, there is provided a guide rail 28 for guiding the bearing means 24 shiftably in the vertical direction which is fitted into a groove 29 provided at the side of the bearing means 24 as shown in FIG. 3(*b*).

The bearing means 24 has upper and lower flat faces. Between the lower flat face and the bottom portion of the window 25, a coil spring 30 is provided for biasing the bearing means 24 upwardly. The upper flat face of the bearing means 24 is abutted to a lower end of a rod 32 of a micro-meter 31 which is fixed on a mounting plate 33 supported on the upper end face of the support plate 22. The micro-meter 31 has an operation knob 34 for shifting the rod 32 in the vertical direction so that the contacting pressure of the press drum 9 may be adjusted by the operation thereof.

Figure 4:
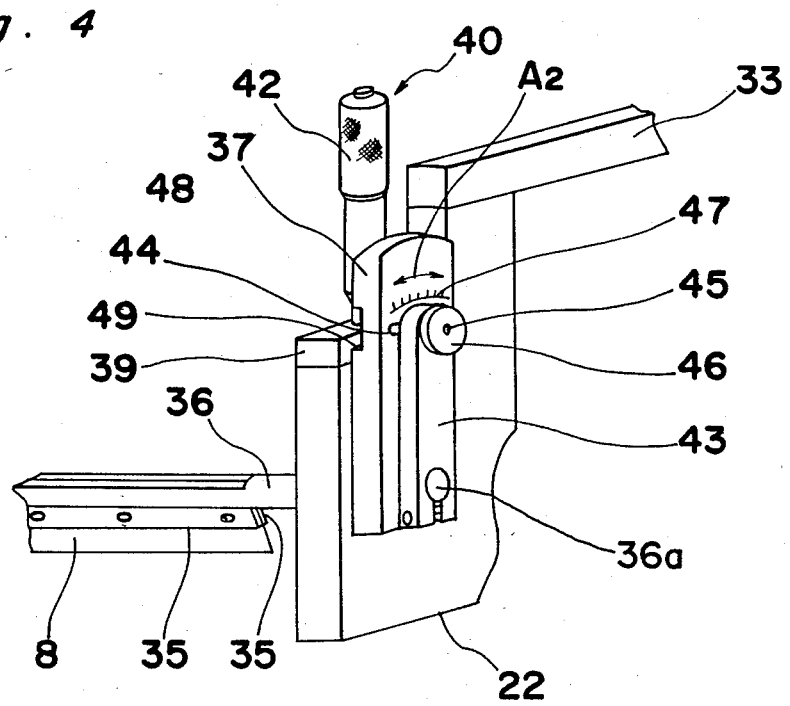
FIG. 4 is a partial perspective view showing assembly provided for adjusting the doctor blade.

As shown in FIG. 4, the doctor blade 8 is holded between two holding plate 35, 35 and is fixed to a support shaft 36 in the notched portion thereof. The support shaft 36 is rotatably supported by a bearing plate 37 which provides said bearing means 26 to be fitted into the window 27 of the support plate 22.

The bearing 26 is, similarly to the bearing 24, urged upwardly by a coil spring 38 put between the lower face of the bearing 26 and the bottom of the window 27 and is adjustable in the position thereof by operation of a micro-meter 40 fixed on a mounting plate 39. Namely, a rod 41 of the micro-meter 40 is shifted upwardly or downwardly, when the operation knob 42 is operated, to shift the bearing 26 and, therefore, the contact pressure of the doctor blade 8 onto the printing plate 4 is adjusted.

The end portion 36*a* of the support shaft 36 for the doctor blade 8 is projected outwardly passing through the bearing 26 and the bearing plate 37 and is fixed to a lever 43.

The lever 43 is provided for adjusting an angle defined between the doctor blade 8 and the printing plate 4. In order for that, there is provided a guide slot 44 of arc-like at the upper portion of the support plate 37 into which a bolt 45 is so engaged as to move slidably along the guide slot 44. Free end of the bolt 45 is projected passing through the upper portion of the lever 43 and projected end thereof is formed threaded so as to engage to a circular knob 46 provided for fastening the lever 43 on the support plate 37. The head portion of the bolt 45 is slidably fitted into a groove 49 provided on the rear surface along the guide slot 44.

Therefore, when the knob 46 is loosened, the lever 43 becomes possible to pivot about the shaft 36 and, accordingly, the angle of the doctor blade 8 is adjusted. A scale 47 is provided along the guide slot 44 for indicating the angle of the doctor blade 8 cooperatively with a index 48 provided on the top of the lever 43.

Figure 5:
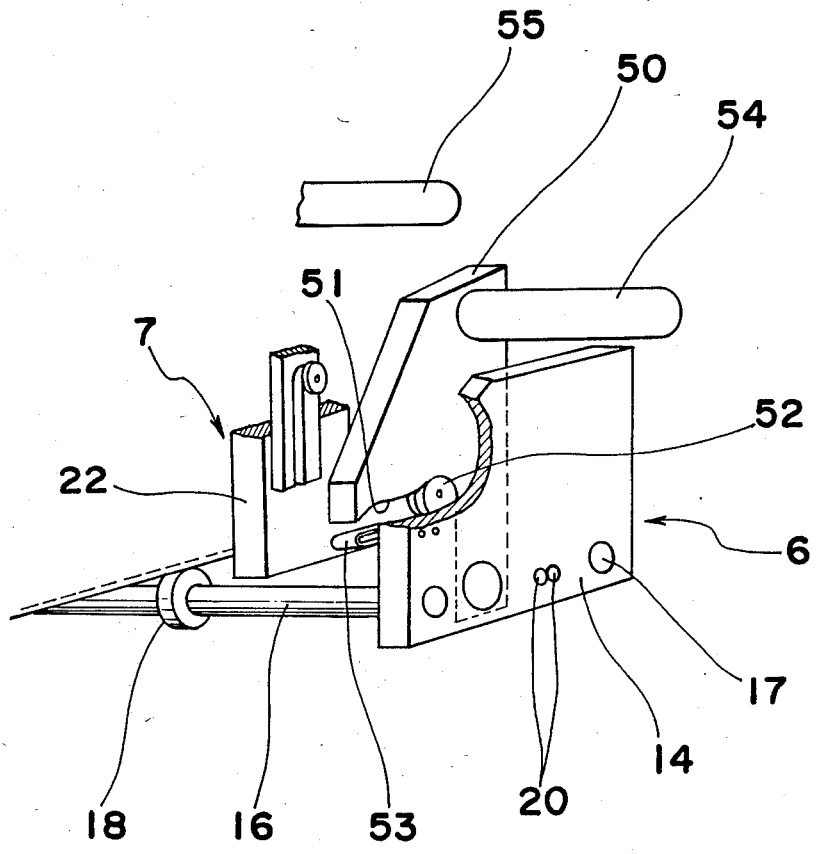
FIG. 5 is a partial perspective view showing locking mechanism of the head.

As shown in FIG. 5, a lock plate 50 of a hook-like configuration is provided for locking the head 7 against the carriage 6 which is positioned between the side plate 14 of the carriage 6 and the support plate 24 of the head 7. The lock plate 50 is supported at its lower end pivotably by the side plate 14 of the carriage 6 which provides a cam 51. This cam 51 is formed so as to cooperate with a cam follower 52 being comprised of a roller which is supported rotatably on the support plate 22. The cam follower 52 is so urged by a leaf spring 53 as to pivot the head 7 about the shaft 17 clockwise when seen in FIG. 5.

As is shown the locked state of the head 7 in FIG. 5, the head 7 can be locked when the cam follower 52 is relatively moved to the innermost end of the cam 51 by rotating the lock plate 50 with an operation rod 54 projected outwardly over the carriage 6 from the upper portion of the lock plate 50. In order to lock the head 7 easily, there is provided a further operation rod 55 being projected parallel to the operation rod 54 from the support plate 22 of the head 7. On locking the head 7, both operation rods 54 and 55 are so forced as to narrow the distance between both rods.

Contrary to the above, the head 7 is unlocked by drawing the rod 54 rearward in the locked state thereof.

Further, there is provided, as shown in FIG. 2, a stopper pin means 57 for setting the initial phase of the press drum 9 or of the material 9*a* to be printed so as to coincide the beginning end of the material 9*a* with that of the printing area of the printing plate 4 when the press drum 9 is transferred to the printing area as it is rotated. The stopper pin 57 is supported at the upper end of a support frame 56 which is mounted at the starting end of the mounting table 2. The support frame 56 is pivotable about an axis 56*a* at the lower end thereof and, therefore, the stopper pin 57 can be inserted into a hole (not shown) provided at a predetermined position of the press drum 9 to set the initial phase of the latter exactly in the state that the head 7 is rotated about the shaft 17 clockwise when seen in FIG. 2. The material 9*a* to be printed onto the press drum 9 is fixed according to a notch (not shown) formed thereon.

Next, the control unit 1 for controlling the carriage 6 will be explained referring to FIGS. 6, 7 and 8.

Figure 6:
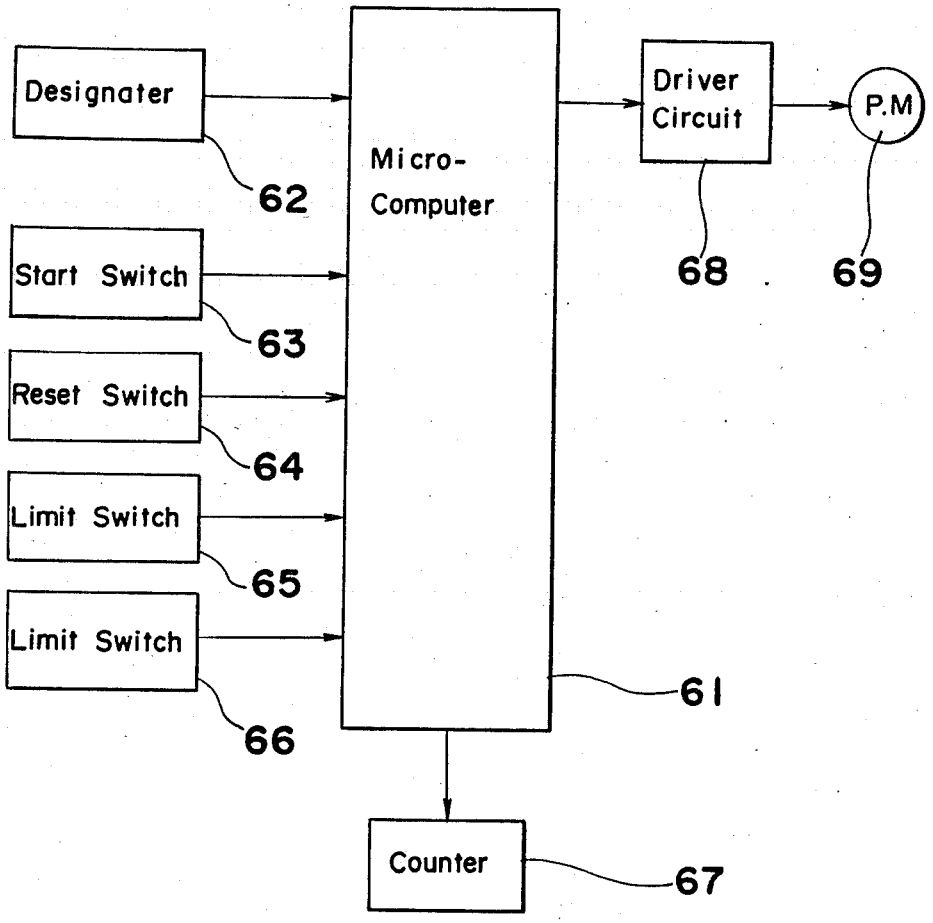
FIG. 6 is a block diagram showing the composition of the control unit.

As is shown schematically in FIG. 6, the control unit 1 is comprised of a micro-computer 61 and appurtenances and controls revolutions of a pulse motor 69. The pulse motor 69 is coupled to the driving pulley 11 for the timing belt 13 to drive the carriage 6. The control unit 1 provides, as appurtenances for the micro-computer, a designater 62 for designating an objective velocity with which the carriage 6 passes the printing area 5 of the printing plate 4; a start switch 63 for starting the carriage 6; a reset switch 64 for resetting the system; a limit switch 65 for detecting that the press drum 9 is positioned at the start position thereof; a limit switch 66 for detecting a possible runaway of the carriage 6; a counter 67 for counting number of proof print; and a driver circuit 68 for driving the pulse motor 69.

The micro-computer 61 controls cycles of driving pulses out-put to the driver circuit 68 in order to drive the pulse motor 69.

In the ROM area (Read Only Memory) of the micro-computer 61, acceleration patterns Pi(t) (i=1, 2, . . . , n) and deceleration patterns Qj(t) (j=1, 2, . . . , n) wherein t is a time measured from the start of the carriage. The numbers i and j are numbers for designating a specified velocity section when whole range of the objective velocity being able to set through the designater 62 is divided into a plurality of sections, for instance, sections of 50 to 75 m/min., of 75 to 100 m/min., of 100 to 150 m/min. and so on.

Figure 7:
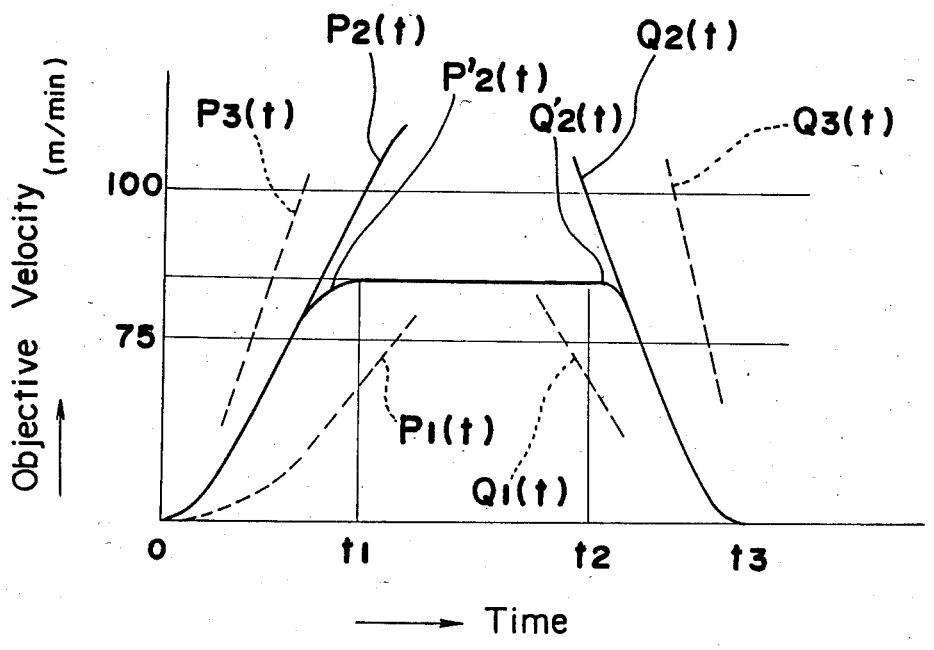
FIG. 7 is a graph showing acceleration and deceleration patterns together with final driving patterns.

These basic patterns Pi(t), Qj(t) are, by way of example, shown in FIG. 7. If the objective velocity is set to 80 m/min. belonging to the second velocity section (i=j=2), $P_2(t)$ and $Q_2(t)$ are chosen among patterns and a final driving pattern is determined according to these basic patterns $P_2(t)$ and $Q_2(t)$.

These basic patterns Pi(t), Qj(t) are determined experimentally so as to describe parabolic curves or the like.

Figure 8:
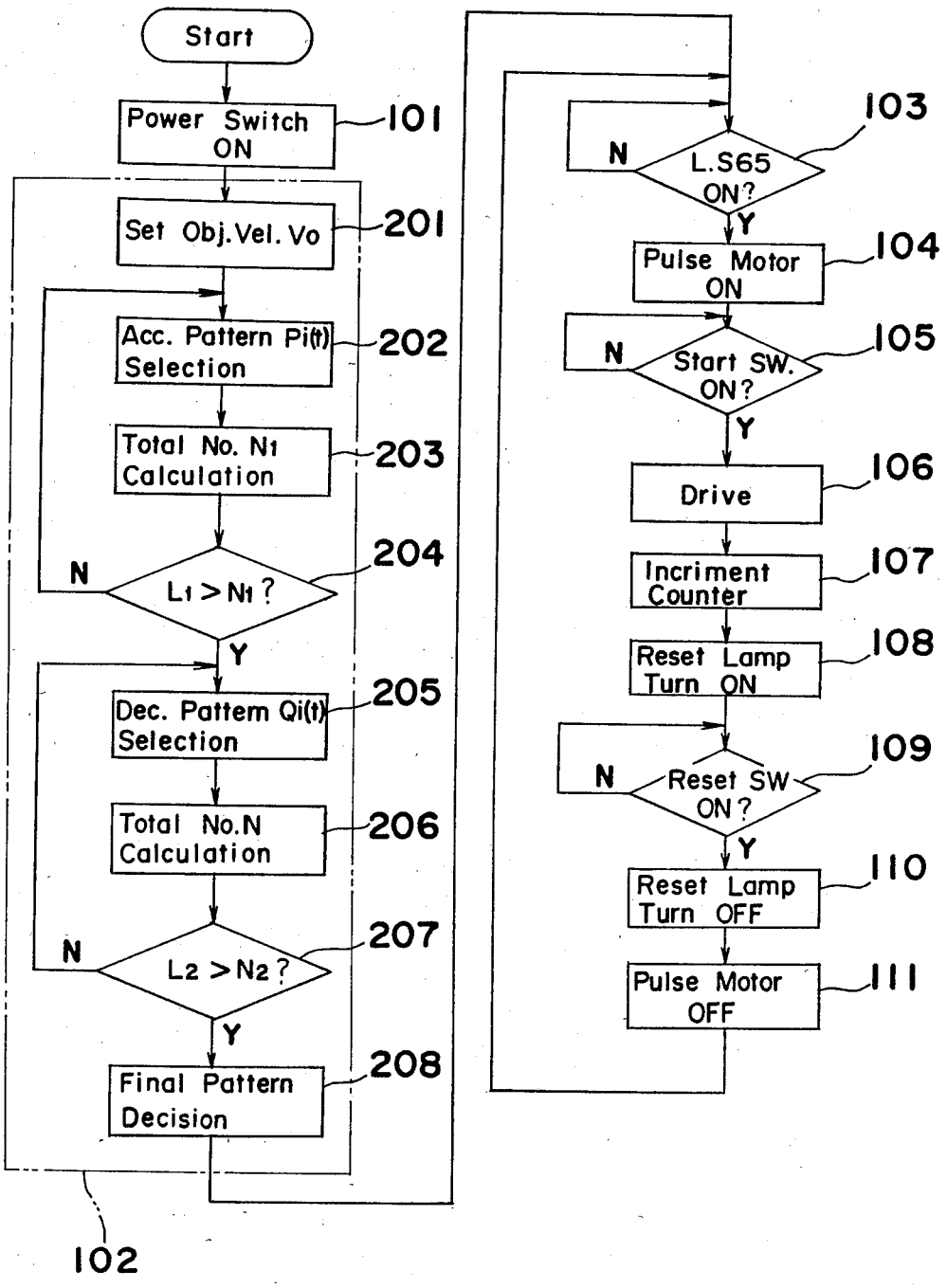
FIG. 8 is a flow chart of the program executed by the micro-computer of the control unit.

FIG. 8 shows a flow chart of a computer program which the micro-computer 61 executes for obtaining a proof print.

When the program is started by switching on the power switch at step 101, the final driving pattern is determined according to steps 201 to 208 encircled by a phantom line 102 in FIG. 8.

First, the objective velocity Vo being designated by the designator 62 is read into at step 201. Then a basic acceleration pattern Pi(t) is selected according to the objective velocity Vo at step 202, as mentioned above. Further, a final acceleration pattern Pi'(t) is determined by calculating such a geometric curve that connects the basic acceleration pattern Pi(t) smoothly with a straight line having the constant value of Vo at the final stage of the acceleration. Once the final acceleration pattern Pi'(t) is determined, the time $t_1$ at which the velocity of the carriage is accelerated up to the objective velocity Vo is calculated according thereto.

At step 203, there is calculated the total number $N_1$ of pulses which are applied to the pulse motor 69 until the velocity attains to the objective velocity Vo, according to the following equation.

$$N_1 = \int_0^{t_1} Pi'(t)dt \tag{1}$$

This total number $N_1$ corresponds to a total distance of approach at the end of which the acceleration having been completed. The total distance should be shorter than the distance $L_1$ defined between the start position So and the first position $S_1$, since, if not, a proof print is begun before the velocity is attained to the objective velocity Vo. This condition is given by the following equation.

$$L_1 > N_1 = \int_0^{t_1} Pi'(t)dt \tag{2}$$

If this condition is judged to satisfy at step 204, the program proceeds to step 205. In other words, the final acceleration pattern Pi'(t) is determined. If this condition is not satisfied, the program is returned to step 202 in order to obtain another acceleration pattern.

At step 205, a basic deceleration pattern Qj(t) is selected according to the objective velocity Vo at first. Then a final deceleration pattern Qj'(t) is determined by calculating such a geometric curve that connects the straight line having the constant value of Vo with the basic deceleration pattern Qj(t) smoothly at the initial stage of the deceleration. Next, time $t_2$ when the deceleration of the carriage should be started is calculated. The time $t_2$ is easily calculated by adding the time $t_1$ to a time taken for the carriage to run from the first position $S_1$ to the second position $S_2$ at the constant objective velocity Vo.

Finally, a time $t_3$ when the carriage is stopped as the result of deceleration of the carriage is calculated according to the final deceleration pattern Qj'(t).

At step 206, a total number $N_2$ of pulses necessary for making the carriage to stop is calculated to a following equation.

$$N_2 = \int_{t_2}^{t_3} Qj'(t)dt \tag{3}$$

Then, the total number $N_2$ obtained is judged at step 207, if a following condition is satisfied.

$$L_2 > N_2 = \int_{t_2}^{t_3} Qj'(t)dt \tag{4}$$

Wherein $L_2$ is the total number of pulses to be applied during the carriage runs from the second position $S_2$ to the third position $S_3$.

If satisfied, the final deceleration pattern Qj'(t) is determined finally.

If not satisfied, the program is returned to step 205 in order to re-calculate another deceleration pattern.

At step 208, the final driving pattern is obtained by the final acceleration pattern Pi'(t), the final deceleration pattern Qj'(t) and the intermediate straight pattern within which the velocity is kept at the objective velocity Vo.

After the determination of the final driving pattern, the program proceeds to step 103.

At step 103, it is judged according to the signal of the limit switch 65 if the press drum is positioned at the starting position So. If the press drum is positioned thereat, the pulse motor 69 is energized to start at step 104. At step 105, it is judged if the starting switch 63 is switched on.

If the starting switch 63 is switched on, the micro-computer 61 drives, via the driver circuit 68, the pulse motor according to the final driving pattern obtained at step 208.

Namely, the carriage is accelerated according to the final acceleration pattern Pi'(t) from the starting position So to the first position $S_1$, is driven at the constant velocity of the objective velocity Vo from the first position $S_1$ to the second position $S_2$ and is decelerated according to the final deceleration pattern Qj'(t) from the second position $S_2$ to the stop position $S_3$.

As is clear from the mentioned above, total number T of pulses applied to the pulse motor from the start to the stop thereof is given by following equation;

$$T = \int_{t_2}^{t_3} Pi'(t)dt + \frac{no}{2\pi r} Vo(t_2 - t_1) + \int_{t_2}^{t_3} Qj'(t)dt$$

wherein r is the radius of the driving pulley 11, no is the number of pulses needed to rotate the pulse motor by one revolution.

During the running of the carriage from the first to second position, the ink having been supplied just before the first position is applied onto the printing area 5 by the doctor blade 8 running before the press drum 9 and the ink applied onto the printing area 5 is transferred onto the material to be printed as the press drum is rotated about the axis thereof contacting to the printing area 5. Thus, one proof print is obtained.

After the carriage is stopped, the micro-computer 61 increments the counter 67 by one at step 107. And, at step 108, the reset lamp (not shown) is turned on to indicate resetting the carriage. At step 109, it is judged if the reset switch 64 is switched on and, when the reset switch is switched on, the reset lamp is turned off at step 110. Then, after ceasing energizing the pulse motor, the program is returned to step 103 for next proof printing.

Having thus described the invention in rather full detail, it will be understood that these details need not be strictly adhered to, but that various changes or modifications may suggest themselves to those skilled in the art, all falling within the scope of the invention as defined by the claims.

What is claimed is:

1. A proof-printing machine comprising an elongated table for mounting a printing plate thereon detachably which is supported by a base frame, a carriage means being movable along the table in the longitudinal direction hereof, a head means being mounted on the carriage means, a doctor blade means for applying ink onto the printing plate so supported by the head means as to be adjustable of its angle and contact pressure against the printing plate, a cylindrical press drum being supported by the head means so as to be rotatable about the axis thereof and adjustable of its contact pressure against the printing plate onto the peripheral surface of which a blank material to be printed is fixed, a pair of timing belt means for transferring the carriage each of which is spanned between a pair of pulleys provided at each end portion of the side wall of the table respectively, a pulse motor for driving said timing belt means, and control means for driving the pulse motor according to a predetermined optimum driving pattern, said control means having memory means memorizing at least one acceleration pattern for accelerating the carriage up to a predetermined objective velocity within a distance defined between start position and first position being set just before the beginning end of the printing area of the printing plate and at least one deceleration pattern for decelerating the carriage from the objective velocity to zero within a distance defined between second position and stop position, said second position being defined as a position where the press drum has been passed the printing area completely and said optimum driving pattern being determined based upon said acceleration and deceleration patterns according to the objective velocity being selectively designated.

2. A proof-printing machine according to claim 1, wherein the head means is supported pivotably by the carriage means.

3. A proof-printing machine according to claim 2, wherein the carriage means provides a lock means for locking the head means at printing position thereof.

4. A proof-printing machine according to claim 1, wherein means for determining the initial phase of the press drum is further provided.

* * * * *